United States Patent [19]

Bressler

[11] 4,082,403

[45] Apr. 4, 1978

[54] MALE CONTACT ASSEMBLY FOR LOADBREAK USAGE

[75] Inventor: David E. Bressler, Long Valley, N.J.

[73] Assignee: Amerace Corporation, New York, N.Y.

[21] Appl. No.: 712,386

[22] Filed: Aug. 6, 1976

[51] Int. Cl.[2] ..... H01R 13/52

[52] U.S. Cl. ..... 339/111; 200/51 R; 339/143 R; 339/DIG. 3

[58] Field of Search ..... 339/111, 46, 94 C, 91 R, 339/60 C, 60 R, 143 R, 117 R, DIG. 3; 200/51 R, 149 A

[56] References Cited

U.S. PATENT DOCUMENTS 4,008,943 2/1977 Flatt et al. ..... 339/111

*Primary Examiner*—Roy Lake
*Assistant Examiner*—DeWalden W. Jones
*Attorney, Agent, or Firm*—S. Michael Bender; Ken Richardson

[57] ABSTRACT

A male contact assembly for high voltage switching applications includes a male contact with an electrically insulative member arranged concentrically with the contact and extending longitudinally therefrom. The insulative member has a hollow interior adjacent the contact and electrically conductive material in such hollow interior is in electrically conductive connection with the contact. Arc-quenching material overlies the insulative member and, on fracturing of such material, the insulative member isolates the electrically conductive material therein and the contact from electrical arcing.

9 Claims, 5 Drawing Figures

MALE CONTACT ASSEMBLY FOR LOADBREAK USAGE

FIELD OF THE INVENTION

This invention relates to electrical connectors and more particularly to contact assemblies for use in high voltage switching applications.

CROSS REFERENCE TO RELATED APPLICATIONS

This application is filed on even date with commonly-assigned application Ser. No. 712,385, filed Aug. 6, 1976, entitled "Male Contact Assembly for Use in Loadbreak" of Robert R. Brown and David E. Bressler, attorney Docket No. EL-960.

BACKGROUND OF THE INVENTION

In the underground power distribution industry, elastomeric elbows and bushings have seen more than a decade of commercial usage as separable connector elements. Such elbows typically comprise housings with an electrically stress-graded end interfittable with a shielded power cable and an opposite end having an elongate cylindrical contact assembly electrically connected to the cable conductor and receivable by a female contact in the bushing. The bushing contact is in turn electrically connected to user apparatus, for example, a transformer or the like. In adapting the elbow-bushing separable connector to usage in electric arcing situations, i.e., loadmake, loadbreak and fault closure conditions, the elbow contact assembly is generally comprised of an electrically conductive contact (rod) and a rod extension (follower) of material adapted to generate arc-extinguishing gases upon being exposed to electric arcing. In turn, the bushing female contact is combined with a block of like arc-extinguishing material.

For safety in the joinder and separation of elbows and bushings under energized circuit conditions, the industry has adopted the so-called "hot-stick" technique, whereby an operator engages the elbow by use of an elongate stick of some ten foot length the thereby moves the elbow into or away from the bushing. With such distance involved, it is unavoidable that occasions arise wherein there is substantial cantilever stressing of the composite rod and rod extension, i.e., where the hot-stick is not axially in alignment with the bushing female contact element. The rod, being of metal, readily accommodates such cantilever stressing. On the other hand, the rod extension, being constituted of non-metallic arc-quenching material, has quite limited resistance to cantilever stress and has been observed to exhibit cracking. In lessening cracking of arc-quenching material upon cantilever stressing thereof, the industry has in the past reinforced the arc-quenching material by running a rigid extension of the rod interiorly of the arc-quenching material for a portion of its length. In these initial embodiments, the art provided such improved cantilever stress resistance by running a rigid electrically conductive (metal pin) member from the male contact to a location axially interior of the extremity of the arc-quenching material, thereby also providing electrical stress relief for the interface of the rod and rod follower.

In a more recent development, set forth in U.S. Pat. No. 3,955,874, it is proposed that the foregoing metal pin member practice is not adequate in that the follower remains susceptible to breakage in its extent axially beyond the pin member. In accommodating its proposed solution to the problem, the effort in such patent provides a solid electrically insulative member of rigid nature extending the full length of the rod follower and includes, for purposes of stress relief, an electrically conductive film on the exterior of such rigid insulative member extending less than the extent of the follower.

In arranging its electrically conductive film directly interiorly of the arc-quenching material, the U.S. Pat. No. 3,955,874 contact assembly exposes such film to electric arcing upon the existence of fissures in the arc-quenching material. A direct electrical path for arcing current flow is accordingly provided to the male contact through the exposed electrically conductive film. Additionally, in this arrangement contact assembly volume at and adjacent the end face of the follower directly exposed to arcing is occupied by the solid electrically insulative member which is coterminus with the follower at such end face.

SUMMARY OF THE INVENTION

The present invention has as its object the provision of improved contact assemblies for use in high voltage switching applications.

It is a more specific object of the present invention to provide contact assemblies of type having a male contact and an associated arc-quenching follower wherein the full extent of the follower is reinforced against fracture by cantilever loading while fault avoidance is provided concomitantly with desired extension of electrical conductivity from the male contact into the follower.

In attaining the foregoing and other objects, the invention provides a male contact assembly having an elongate male contact with a follower of arc-quenching material extending longitudinally outwardly thereof, a rigid electrically insulative member extending preferably the full length of such follower interiorly thereof and defining a hollow interior extending at least partially along the insulative member and containing an electrically conductive element, electrically connected to the male contact. In such assembly, on fissure of the follower at any location of its extent, the electrically insulative rigid member isolates the conductive element from an arcing condition which may exist, thereby isolating the contact from the arcing situation. In its preferred form, the rigid member is comprised of a hollow cylindrical member and the conductive element is an electrically conductive coating on the interior of the hollow rigid member.

The foregoing and other objects and features of the invention will be evident from the following detailed description of the invention as embodied in preferred embodiments thereof and from the drawings wherein like reference numerals identify like parts throughout.

DESCRIPTION OF THE PREFERRED EMBODIMENTS AND PRACTICES

Figure 1:
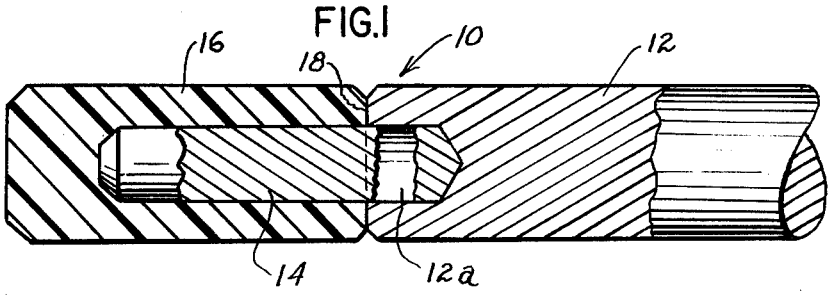
PRIOR ART FIG.1
FIGS. 1 and 2 show prior art efforts discussed heretofore, each such figure being a sectional elevation of a male contact assembly.

Referring to FIG. 1, male contact assembly 10, secured to the elbow of the above-discussed elastomeric elbow-bushing connector, includes an elongate male contact element or rod 12 having rightward extremity (not shown) exteriorly threaded to engage such elbow. Element 12 defines a bore 12*a* concentric therewith and opening into its end distal from such exteriorly threaded extremity for receipt of rod extension 14, comprising an electrically conductive pin-shaped member of lesser diameter than that of cylindrically-shaped element 12. In making assembly 10, rod extension 14 is inserted in bore 12*a*, e.g., by press-fitting of the components. Molded on an axially outwardly of extension 14 is follower 16, comprised of material adapted to issue arc-extinguishing gases upon being exposed to an electrical arc struck between assembly 10 and a female contact assembly in such bushing noted above. Materials for constituting the rod, rod extension and follower are commonly known. As alluded to heretofore, the FIG. 1 structure has cantilever strength evidently beyond that of a contact assembly of type dispensing with rod extension 14 and having the rod and follower axially abutting diametrically throughout joinder line 18. Also, extension 14 is effective to extend the electrically conductive continuity of the assembly axially beyond such joinder line 18, providing improved electrical stress relief.

Figure 2:
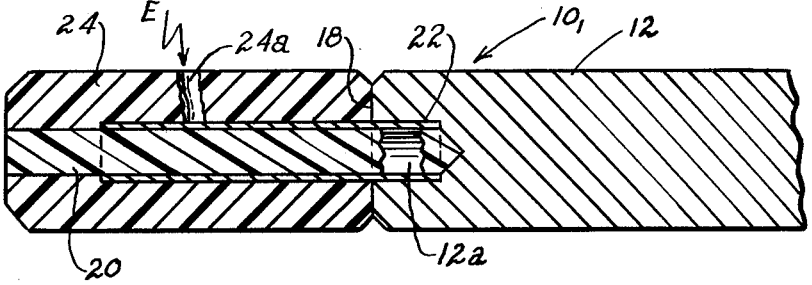

FIG. 2 shows a male contact assembly $\mathbf{10}_1$ of the type shown in the above-referenced U.S. Pat. No. 3,955,874 patent wherein an electrically insulative extension 20 is disposed in the bore 12*a* of rod 12 and is encircled therein by electrically conductive film 22. Rod extension 20 will be seen to run the full axial extent of follower 24, i.e., from abutment line 18 to the leftward contact assembly extremity, with film 22 extending outwardly longitudinally of joinder line 18 in encircling relation to rod extension 20. As will be seen in FIG. 2 at presumed fissure 24*a* in follower 24, which may be occasioned by cantilever stressing of the contact assembly, coating 22 is directly exposed to electrical arc E impinging upon the contact assembly. With these presumed conditions, a path of electrical conductivity exists directly through to contact 12.

Figure 3:
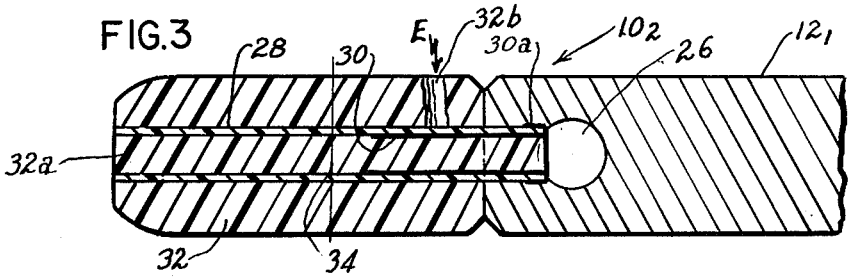
FIG. 3 is a sectional elevation of a male contact assembly constructed in accordance with the invention.
Figure 4:
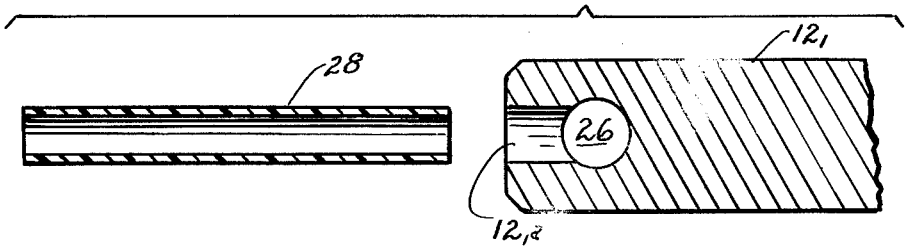
FIG. 4 is a sectional elevation of parts of the FIG. 3 assembly prior to assembling thereof.
Figure 5:
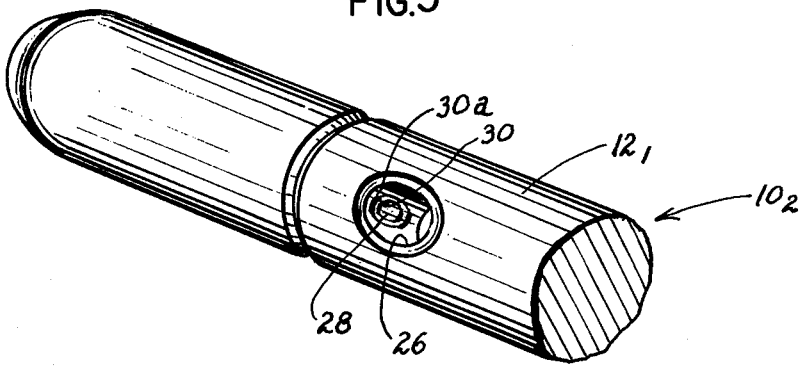
FIG. 5 is a perspective view of a contact assembly in accordance with the invention.

In the contact assembly $\mathbf{10}_2$ of the invention shown in FIGS. 3, 4 and 5, circular passage 26 is formed diametrically through rod $\mathbf{12}_1$ communicating with the rightward end of bore $\mathbf{12}_1a$. Hollow cylindrical reinforcing tube 28, of electrically insulative material, is situate in bore $\mathbf{12}_1a$ in interference fit or other fixed relation thereto and extends to the leftward extremity of the contact assembly. An electrically conductive film or coating 30 lines the interior of hollow tube 28 longitudinally leftwardly of rod $\mathbf{12}_1$ and also extends interiorly of rod $\mathbf{12}_1$ to passage 26 at which location the coating is contiguous with and in electrical contact with rod $\mathbf{12}_1$, as by coating portion 30*a* disposed in intervening relation to rod $\mathbf{12}_1$ and the radially exterior surface of tube 28. Follower 32, generally ogive-shaped at its leftward end face, is in encircling relation to the radially outward surface of tube 28 axially leftwardly of joinder line 18 and includes a part 32*a* encircled by tube 28 and its interior coating 30. In accordance with varied practice under the invention, such tube-interior part 32*a* of follower 32 may extend short of coating 30, i.e., longitudinally rightwardly from the leftward end face of the contact assembly to, for example, line 34. As will be noted, the leftward end face of the contact assembly has substantially all of its surface, as well as the assembly volume adjacent such end face, constituted by arc-quenching material.

By way of example of making the contact assembly of FIG. 3, rod $\mathbf{12}_1$ is preformed as in FIG. 4, i.e., with bore $\mathbf{12}_1a$ communicating with passage 26. Tube 28 is a preformed rigid self-sustaining member as also noted in FIG. 4. Next, a glob or drop of fluidized electrically conductive material is applied through passage 26 to the sidewall of bore $\mathbf{12}_1a$ adjacent passage 26, and tube 28 is press-fit into the coated bore. Coating 30 is now applied, as by swabbing or painting, to the interior of tube 28. Finally, such subassembly has the arc-quenching material molded thereabout and therein as shown in FIG. 3.

Assuming a fissure 32*b* (FIG. 3) to exist in arc-quenching material 32, it will be seen that tube 28 isolates coating 30 from electric arc E incident on the assembly at the fissure location. Accordingly, contact $\mathbf{12}_1$ is electrically insulated from the arcing condition.

Coating 30 may be applied as a semiconductive liquid which solidifies by solvent evaporation under ambient atmospheric conditions or by going through a curing phase. As will be appreciated, since the coating functions in extending the contact electrical potential rather than as a current carrier, high electrical conductivity is not required. The coating material may be a semi-solid, liquid or paste of colloidal graphite type, e.g., dag, aquadag, and the like. Tube 28 is preferably comprised of one of the NEMA grade high pressure laminates, for example, Grades G5, G7, G10 and G11. By way of example, tube 28 may be a G10 epoxy tube with outer diameter 5/16 inch and inner diameter 3/16 inch. Follower 32 may have an outer diameter of $\frac{1}{2}$ inch. With follower length to joinder line 18 at 1.9 inches, tube 28 may extend rightwardly of line 18 for $\frac{1}{2}$ to $\frac{5}{8}$ inch. Coating 30 may extend leftwardly of line 18 for $\frac{3}{4}$ to $1\frac{1}{4}$ inches.

Assemblies in accordance with the invention exhibit lesser severity of cracking of arc-quenching material upon being subjected to both drop-testing and cantilever loading as against the prior art assemblies of FIGS. 1 and 2. In the drop-testing, contact assemblies are dropped by hand onto a concrete pad from a waist-high level and are also dropped through an eight foot pipe onto a steel pad. Additionally, the assemblies are impacted by a steel rod dropped thereon through such pipe. In cantilever loading, loads are applied transversely of the longitudinal axis of the assemblies, with loading increased step-wise until cracking of the arc-quenching material occurs in various degrees.

Various changes and modifications made as will be evident to those skilled in the art may be introduced in the foregoing embodiments and practices without departing from the invention. Thus, the particularly illustrated embodiments and disclosed practices are intended in an illustrative and not in a limiting sense. The true spirit and scope of the invention is set forth in the following claims.

I claim:

1. A male contact assembly comprising:

(a) an elongate male contact of electrically conductive material;

(b) an electrically insulative member secured to said male contact and extending longitudinally therefrom, said insulative member defining a hollow interior extending at least partly therewith;

(c) electrically conductive means in said insulative member interior and connected to said male contact for electrically longitudinally extending said male contact; and (d) a longitudinally extending layer overlying said insulative member and comprised of material generating arc-extinguishing gases upon exposure to electrical arcing, the longitudinal extent of said layer being greater than the longitudinal extent of said electrically conductive means in said insulative member.

2. The male contact assembly claimed in claim 1 wherein said electrically conductive means comprises a coating of electrically conductive material on said insulative member interior and engaging said male contact.

3. A male contact assembly comprising:

(a) an elongate male contact and electrically conductive material;

(b) an electrically insulative member secured to said male contact and extending longitudinally therefrom, said insulative member defining a hollow interior extending at least partly therewith;

(c) electrically conductive means in said insulative member interior and connected to said male contact for electrically longitudinally extending said male contact; and (d) a layer overlying said insulative member and comprised of material generating arc-extinguishing gases upon exposure to electrical arcing, wherein said insulative member comprises a hollow tube extending the full longitudinal extent of said overlying layer.

4. The male contact assembly claimed in claim 3 wherein said tube further contains therein material generating arc-extinguishing gases upon exposure to electrical arcing.

5. The male contact element claimed in claim 1 wherein said male contact comprises a cylindrical member defining an axial bore for receiving said insulative member and a passage opening into the exterior surface of said cylindrical member and communicating with said bore.

6. The male contact element claimed in claim 5 wherein said insulative member comprises a hollow tube having an end portion situate in said cylindrical member axial bore, and wherein said electrically conductive means comprises a coating of electrically conductive material on the interior of said tube and engaging said cylindrical member.

7. The male contact element claimed in claim 6 wherein said coating includes a portion in said cylindrical member axial bore disposed between said tube and said cylindrical member.

8. A male contact assembly comprising:

(a) an elongate male contact of electrically conductive material;

(b) an electrically insulative member secured to said male contact and extending longitudinally therefrom, said insulative member defining a hollow interior extending at least partly therewith;

(c) electrically conductive means in said insulative member interior and connected to said male contact for electrically longitudinally extending said male contact, the longitudinal extent of said electrically conductive means being less than the longitudinal extent of said insulative member; and (d) a layer overlying said insulative member and comprised of material generating arc-extinguishing gases upon exposure to electrical arcing.

9. The invention of claim 8 wherein said insulative member further includes interiorly thereof material generating arc-extinguishing gases upon exposure to electrical arcing.

* * * * *